US008105117B2

(12) United States Patent
Ikegami et al.

(10) Patent No.: US 8,105,117 B2
(45) Date of Patent: Jan. 31, 2012

(54) SPRING CONNECTOR AND TERMINAL DEVICE

(75) Inventors: Masatoshi Ikegami, Chiba (JP); Rie Sugimori, Tokyo (JP)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 12/759,968

(22) Filed: Apr. 14, 2010

(65) Prior Publication Data

US 2010/0267290 A1 Oct. 21, 2010

(30) Foreign Application Priority Data

Apr. 20, 2009 (JP) ..... P2009-102244

(51) Int. Cl.
*H01R 13/24* (2006.01)

(52) U.S. Cl. ..... 439/700; 439/862

(58) Field of Classification Search ..... 439/66, 439/482, 700, 824, 816–818, 862
See application file for complete search history.

(56) References Cited

U.S. PATENT DOCUMENTS

| | | | | |
|---|---|---|---|---|
| 6,863,576 | B2 * | 3/2005 | Campbell et al. | 439/700 |
| 7,270,550 | B1 * | 9/2007 | Peng | 439/66 |
| 7,789,719 | B1 * | 9/2010 | Yin et al. | 439/824 |
| 7,813,142 | B2 * | 10/2010 | Lin et al. | 361/772 |
| 7,815,474 | B1 * | 10/2010 | Lin et al. | 439/700 |
| 7,857,671 | B2 * | 12/2010 | Carboni et al. | 439/824 |

FOREIGN PATENT DOCUMENTS

| | | |
|---|---|---|
| JP | 10 214649 | 8/1998 |
| JP | 2000 195600 | 7/2000 |
| JP | 2003 178848 | 6/2003 |
| JP | 2004 192968 | 7/2004 |

* cited by examiner

*Primary Examiner* — Thanh Tam Le
(74) *Attorney, Agent, or Firm* — Frommer Lawrence & Haug LLP; William S. Frommer; Ellen Marcie Emas

(57) ABSTRACT

A spring connector includes an inner conductor and an outer conductor. The inner conductor is formed of a conductive material, and has a small-diameter portion, a large-diameter portion, and a resilient portion axially disposed so as to be integrally and continuously formed with each other. The outer conductor is formed of a conductive material, and is provided with a hole having a predetermined inside diameter. The outer conductor accommodates the large-diameter portion and the resilient portion in the hole while the small-diameter portion protrudes from an end of the hole.

5 Claims, 11 Drawing Sheets

SPRING CONNECTOR AND TERMINAL DEVICE

BACKGROUND OF THE INVENTION

1. Field of the Invention

The present invention relates to a suitable spring connector used in, for example, a battery terminal of a cellular phone terminal, and to a terminal device including the spring connector.

2. Description of the Related Art

Hitherto, in an electronic device, such as a cellular phone terminal, a spring connector is mounted to a surface of a principle circuit board when an electrical component at, for example, a partial circuit board or a battery is connected to the principle circuit board. A spring connector is mounted by pushing a terminal electrode of the electrical component against a movable end that is urged by a spring. By this, electrical connection is achieved.

FIGS. 10 and 11 each show an example of a related spring connector. FIG. 11 shows the entire structure of a spring connector 40. FIG. 10 is a vertical sectional view taken along line X-X in FIG. 11. As shown in FIG. 10, in the spring connector 40, a plunger 11 and a coil spring 12 are accommodated in a tube 13 having a hollow interior. The plunger 11, the coil spring 12, and the tube 13 are formed of conductive metal. In the tube 13, a base portion 13*a* has a somewhat large diameter, and a bottom portion 13*c* of a circular hollow cylinder 13*b* is formed in the base portion 13*a* so as to have a conical shape. A coil spring 12 is disposed at a base-end side (bottom-portion-13*c* side) of the interior of the hollow cylinder 13*b*. The plunger 11 is disposed at a front-end side of the interior of the hollow cylinder 13*b*. The plunger 11 has a large-diameter portion 11*a*, which fits in the hollow cylinder 13*b*, and a small-diameter portion 11*b*, whose front end is exposed from the tube 13. A front end 13*d* of the tube 13 is narrowed. A stepped portion 11*c*, disposed between the large-diameter portion 11*a* and the small-diameter portion 11*b* of the plunger 11, engages with and is stopped by the front end 13*d* of the tube 13 to accommodate the plunger 11 in the tube 13.

The coil spring 12 is disposed in a compressed state in the tube 13, and pushes up the plunger 11 towards the front (the top in FIG. 10). In the spring connector 40 having such a structure, conduction is achieved by contact at a contact 1, a contact 2, and a contact 3. Accordingly, the plunger 11 and the tube 13 are in electrical conduction. The contact 1 is where the plunger 11 contacts an inside diameter portion of the tube 13. The contact 2 is where the coil spring 12 and the tube 13 contact each other. The contact 3 is where the plunger 11 and the coil spring 12 contact each other.

Therefore, the base portion 13*a* of the tube 13 is connected to a circuit board (not shown), and an end of the small-diameter portion 11*b* of the plunger 11 is brought into contact with a predetermined portion, such as a conductive portion of a battery, to achieve electrical connection.

In this case, the plunger 11 can be pushed into the interior of the tube 13 in correspondence with an amount by which the coil spring 12 can be compressed.

Japanese Unexamined Patent Application Publication No. 2004-192968 (Patent Document 1) discusses an example of this type of spring connector. Patent Document 1 discusses a structure in which a stable conductive path is provided by increasing the length of the coil spring pushing out the plunger.

SUMMARY OF THE INVENTION

In related spring connectors, a coil spring and a plunger are inserted into a tube in turns. The upper edge of the tube is narrowed inwardly to hold a stepped portion of the plunger, so as to hold the plunger in such a way that it does not fall off. Therefore, a large number of electrical contacts are provided in the interior of the tube. For example, as shown in FIG. 10, the interior of the tube has the contact 1 between the plunger 11 and the tube 13, the contact 3 between the plunger 11 and the coil spring 12, and the contact 2 between the coil spring 12 the tube 13. From the viewpoint of achieving stability of an electrically conductive state, such contacts have low contact reliability. That is, when the plunger 11 tries to move due to some external force applied to the plunger 11, the contact states of the aforementioned contacts 1, 2, and 3 become unstable. Therefore, the spring connector does not often stably function as a connector. In addition, for example, in the case where the spring connector is used in a battery portion of an electronic device, such as a cellular phone terminal, the plunger 11 and the coil spring 12 are instantaneously cut off from each other when, for example, the terminal falls to the ground and an external shock is applied to the cellular phone terminal. That is, what is called "instantaneous cutoff" occurs. When the "instantaneous cutoff" occurs, problems result in that, for example, setting content of the cellular phone terminal is reset and a portion of data is lost.

In view of the aforementioned points, it is desirable to increase contact reliability of a spring connector.

According to an embodiment of the present invention, there is provided a spring connector including an inner conductor, formed of a conductive material, and an outer conductor, accommodating the inner conductor. The inner conductor has a form in which a small-diameter portion, a large-diameter portion, and a resilient portion are axially disposed so as to be integrally and continuously formed with each other. The outer conductor is provided with a hole having a predetermined inside diameter. The large-diameter portion and the resilient portion of the inner conductor are accommodated in the hole of the outer conductor while the small-diameter portion protrudes from an end of the hole.

Accordingly, the small-diameter portion and the large-diameter portion of the spring connector together function as a plunger, and the plunger is pushed up by the resilient portion integrated to the large-diameter portion of the spring connector, so that this structure function as a spring connector.

According to the embodiment of the present invention, since the inner conductor constituting the plunger of the spring connector is integrated to the resilient portion, the large-diameter portion and the small-diameter portion (which constitute the plunger) and the resilient portion (which is a spring) are reliably in electrical conduction with each other, so that it is possible to achieve a good electrical connection state in the spring connector.

DESCRIPTION OF THE PREFERRED EMBODIMENTS

Embodiments of the present invention will hereunder be described in the order of the following items 1 to 6:

1. Exemplary structure of a spring connector according to a first embodiment (FIGS. 1 and 2)
2. Process of producing the spring connector according to the first embodiment (FIGS. 5A and 5B and 6A to 6C)
3. Exemplary structure of a terminal provided with the spring connector (FIGS. 3A and 3B and 4)
4. Exemplary structure of a spring connector according to a second embodiment (FIG. 7)
5. Function of the spring connector according to the second embodiment
6. Method of producing a modification of an embodiment (FIGS. 8*a* to 8*c* and 9*a* to 9*c*)

1. Exemplary Structure of Spring Connector

The first embodiment of the present invention will hereunder be described with reference to FIGS. 1 to 6.

Figure 1:
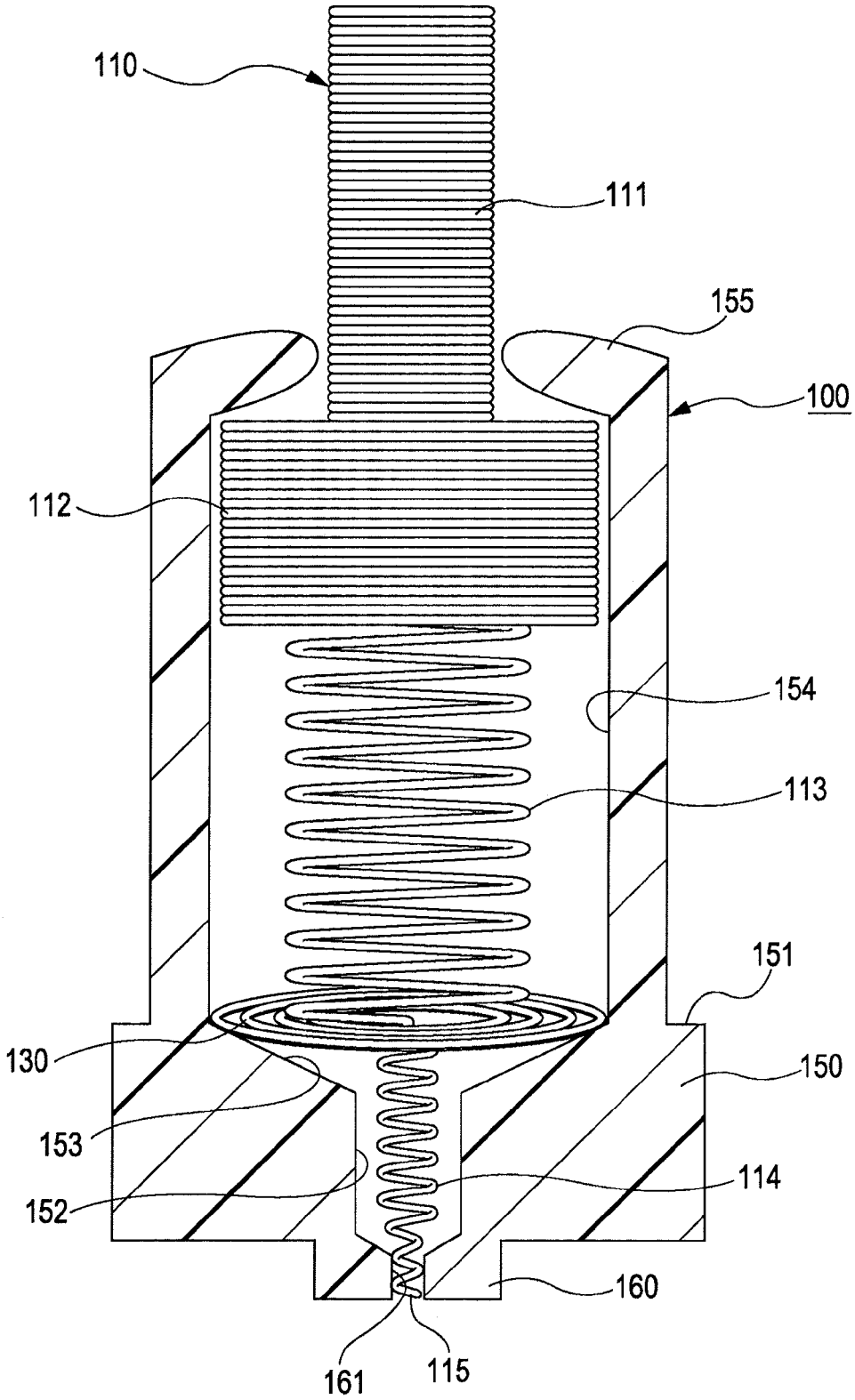
FIG. 1 is a sectional view of a spring connector according to a first embodiment of the present invention along line I-I in FIG. 2.
Figure 2:
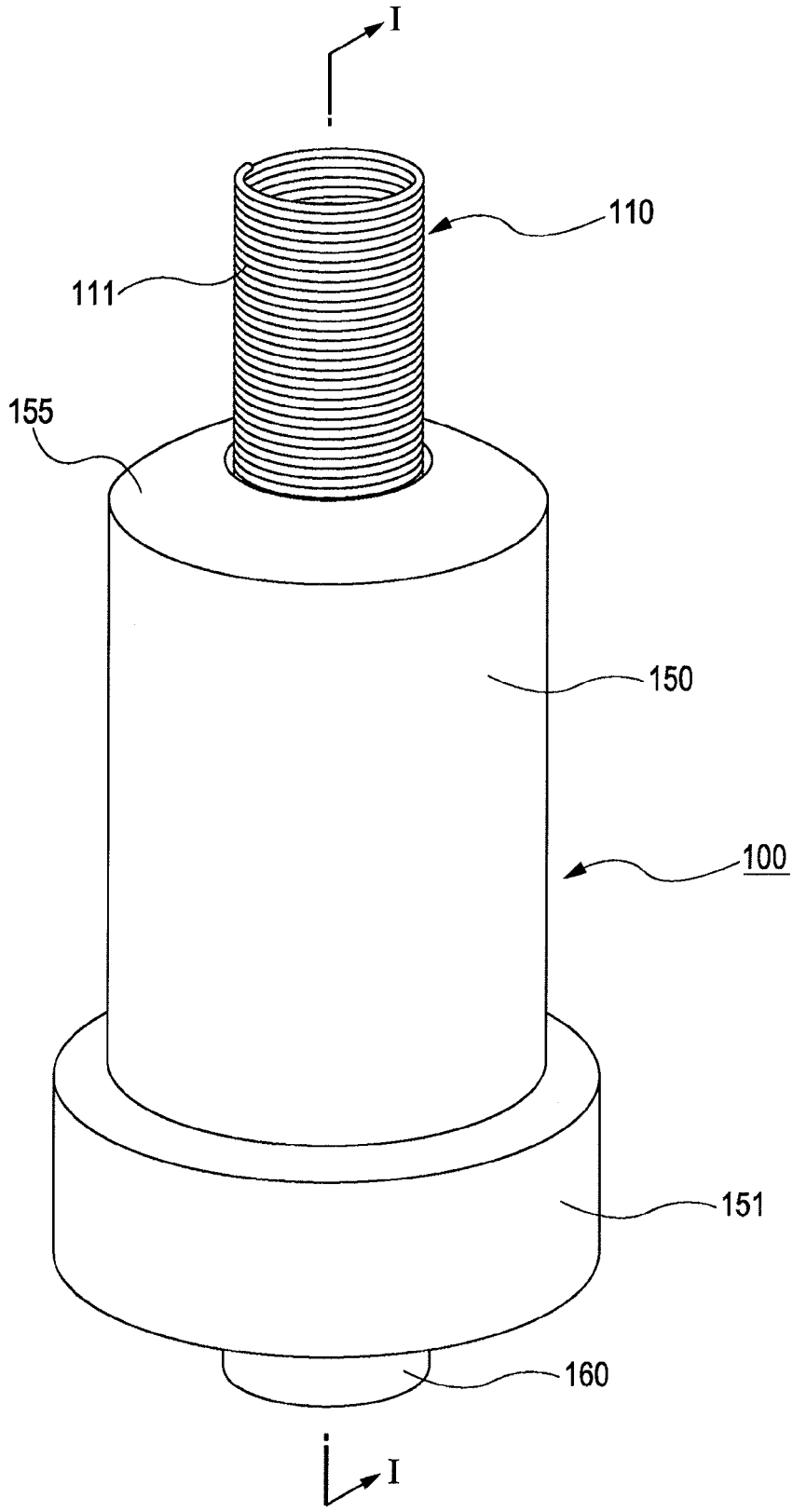
FIG. 2 is a perspective view of the spring connector according to the first embodiment of the present invention.

FIGS. 1 and 2 each show the shape of a spring connector 100 according to the embodiment. FIG. 2 is a perspective view of the overall shape of the spring connector 100. FIG. 1 is a vertical sectional view taken along line I-I in FIG. 2. When a vertical direction is indicated in the following description, this vertical direction indicates a positional relationship shown in FIGS. 1 and 2.

As shown in FIG. 1, the spring connector 100 includes an inner conductor, formed of a conductive material, and an outer conductor, accommodating the inner conductor. That is, a pin-provided spring 110, formed of a conductive material (such as a metal), is accommodated in a tube 150, formed of a conductive material (such as a metal) and having a hollow inner side. The pin-provided spring 110 functions as a plunger and as a resilient member (spring). A detailed structure of the pin-provided spring 110 will be described later.

The pin-provided spring 110 includes a small-diameter portion 111, a large-diameter portion 112, a coil spring portion 113, and a tube connection portion 114. The portions 111 to 114 are coaxially, continuously, and integrally formed with respect to each other. The tube 150 accommodating the pin-provided spring 110 is such that its base end side is a base portion 151 and such that a circular small-diameter clearance hole section 152 is provided in the base portion 151. A circular large-diameter clearance hole section 154 is formed continuously with the small-diameter clearance hole section 152. A conical portion 153 connects the small-diameter clearance hole section 152 and the large-diameter clearance hole section 154 to each other. A crimp portion 160 slightly protruding from the base portion 151 is provided at the lower end of the base portion 151 to crimp an end 115 of the tube connection portion 114 of the pin-provided spring 110.

The small-diameter portion 111 of the pin-provided spring 110 is exposed to the outside from an end 155 at the upper side of the large-diameter clearance hole section 154 of the tube 150. The end 155 of the tube 150 is narrowed, and is formed so that the large-diameter portion 112 of the pin-provided spring 110 does not fly out to the outside.

A fastener 130 is mounted to the coil spring portion 113 of the pin-provided spring 110. Using the fastener 130, the coil spring portion 113 is secured to the large-diameter clearance hole section 154 in the tube 150. Although it is desirable to form the fastener 130 out of a conductive material such as a metal, the fastener 130 may be formed of synthetic resin.

As shown in FIG. 2, the small-diameter portion 111 protruding from the end 155 of the tube 150 can sink into the tube 150 by moving downward in a range in which the coil spring portion 113 in the tube 150 can be resiliently deformed (that is, compressed).

2. Process of Producing the Spring Connector According to the First Embodiment

Next, a process of producing the pin-provided spring 110 according to the embodiment will be described with reference to FIGS. 5A and 5B and 6A to 6C.

In the embodiment, the pin-provided spring 110 is formed by winding a wire rod into the form of a spring. That is, as shown in FIG. 5A, a conductive metal cable 310 is pulled from a drum 300 upon which the conductive metal cable 310 is wound.

Figure 5A:
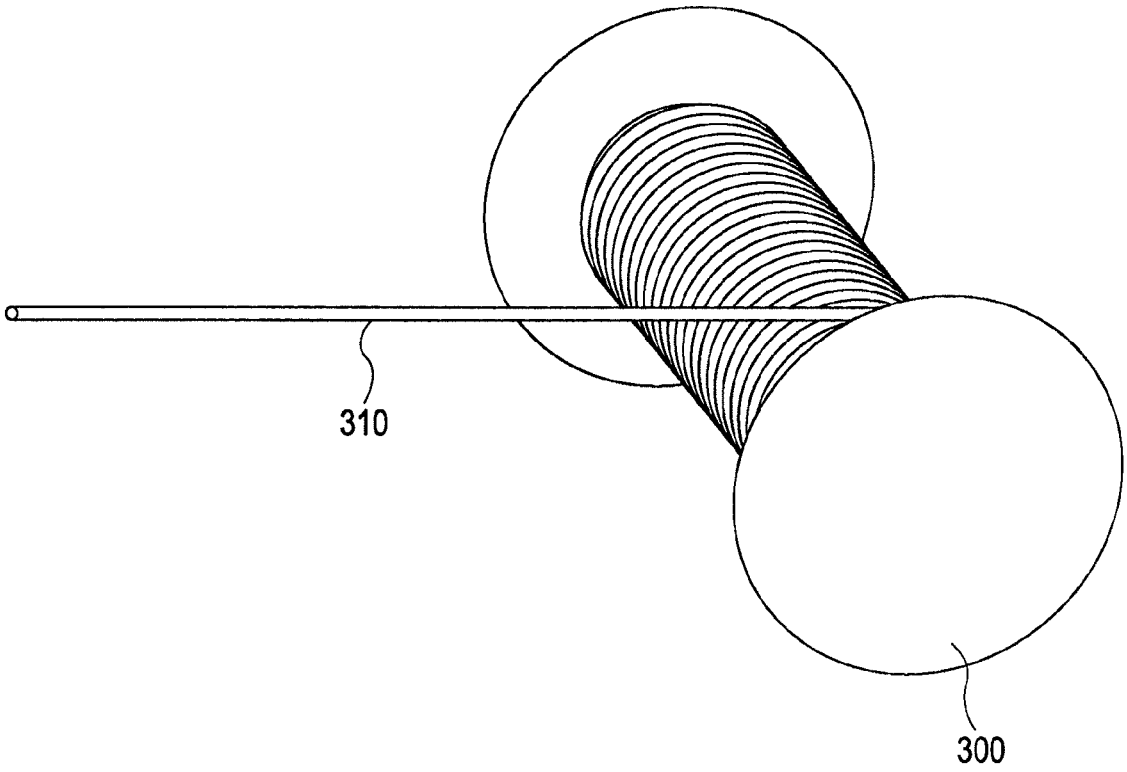
FIGS. 5A and 5B illustrate a process of producing a pin-provided spring according to the first embodiment of the present invention.
Figure 5B:
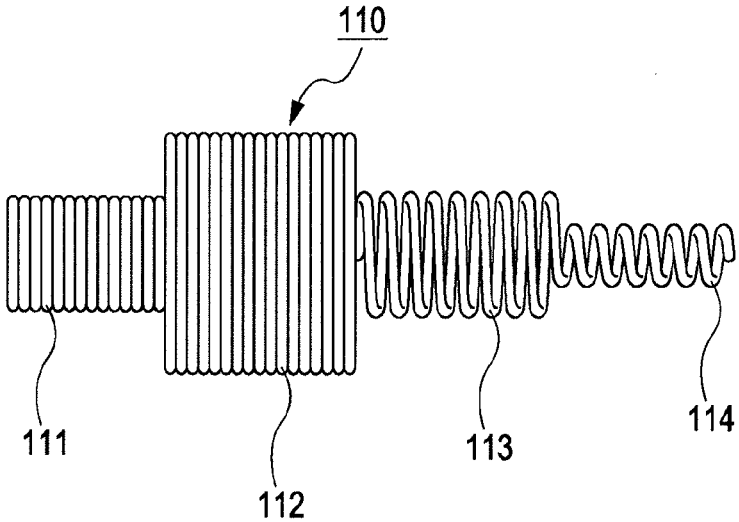

As shown in FIG. 5B, the pulled metal cable 310 is spirally wound in a circular form from an end thereof, to form the small-diameter portion 111, the large-diameter portion 112, the coil spring portion 113, and the tube connection portion 114. In this case, for the small-diameter portion 111 and the large-diameter portion 112, the metal cable 310 is wound so that its portions are in contact with each other, that is, without any gaps between its portions. For the coil spring portion 113, the metal cable 310 is wound so that certain gaps are formed between its portions, thereby allowing the coil spring portion 113 to function as a compression coil spring providing resilient force. Even for the tube connection portion 114, the metal cable 310 is wound so that certain gaps are formed between its portions. Thereafter, the metal cable 310 formed as the pin-provided spring 110 is cut from the drum 300.

Next, a process of disposing the pin-provided spring 110 in the tube 150 will be described with reference to FIGS. 6A to 6C.

Figure 6A:
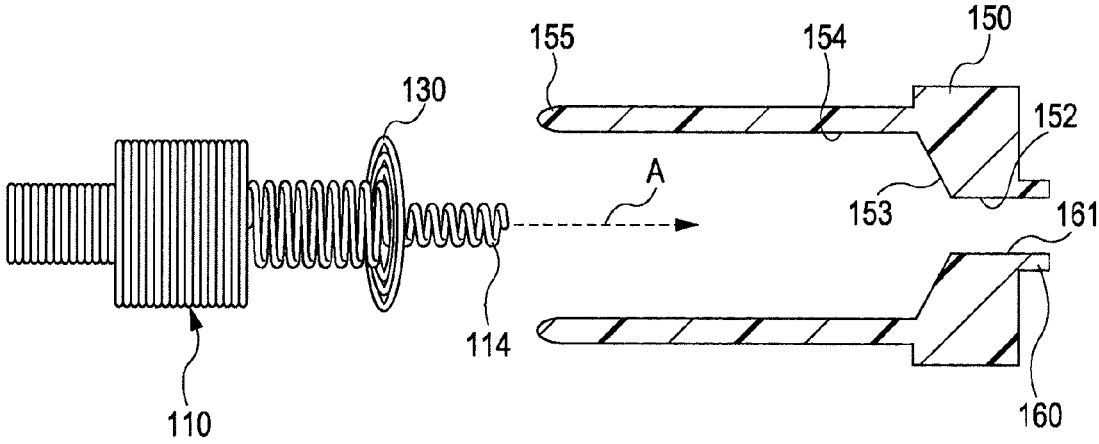
FIGS. 6A to 6C illustrate a process of producing the spring connector according to the first embodiment of the present invention.

As shown in FIG. 6A, the fastener 130 is mounted between the tube connection portion 114 and the coil spring portion 113 of the pin-provided spring 110 obtained in the process shown in FIGS. 5A and 5B. Although, in FIGS. 6A to 6C, the fastener 130 is shown in a spiral form, the fastener 130 may have any form as long as it functions as a fastener.

Then, as indicated by an arrow A in FIG. 6A, an end of the tube connection portion 114 of the pin-provided spring 110 is inserted into the small-diameter clearance hole section 152 from the upper side of the tube 150. During this operation, an end of the tube 150 is not yet narrowed.

Figure 6B:
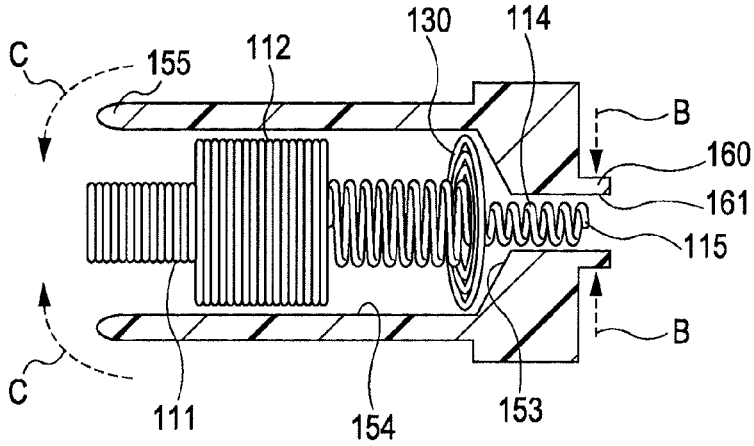

FIG. 6B shows a state in which the pin-provided spring 110 is disposed in the tube 150 in this way. In this state, with the end 115 of the tube connection portion 114 of the pin-provided spring 110 being inserted into a hole 161 in the crimp portion 160, as shown by an arrow B in FIG. 6B, the crimp portion 160 is narrowed; and, as shown in FIG. 6C, the end 115 of the pin-provided spring 110 is crimped at the tube 150.

Figure 6C:
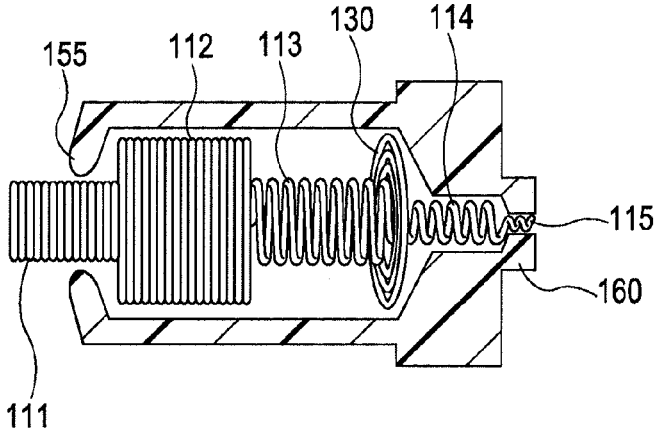

As shown by arrows C in FIG. 6B, the end 155 of the tube 150 is narrowed towards the inner side, so that, as shown in FIG. 6C, the end 155 has a form that prevents the large-diameter portion 112 of the pin-provided spring 110 from flying out.

3. Exemplary Structure of a Terminal Provided with the Spring Connector

Next, an exemplary structure of a cellular phone terminal 10 having the spring connector 100 according to the embodiment mounted thereto is described with reference to FIGS. 3 and 4.

In the embodiment, the spring connector 100 is used as a terminal of a mounting portion of a battery 20 of the cellular phone terminal 10.

Figure 4:
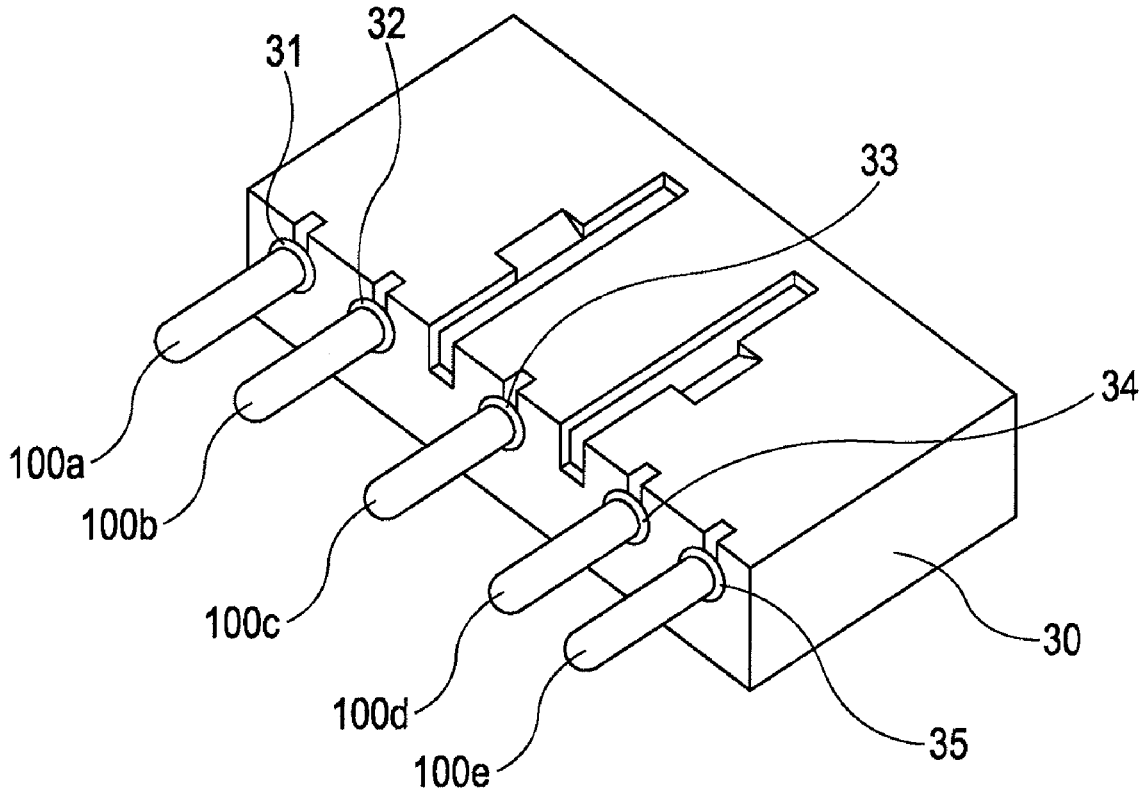
FIG. 4 is a perspective view showing an example in which a group of the spring connectors according to the first embodiment of the present invention is mounted to a spring-connector group container.

That is, as shown in FIG. 4, five spring connectors 100*a*, 100*b*, 100*c*, 100*d*, and 100*e*, each having the same structure as the previously described spring connector 100, are provided. These five spring connectors 100*a* to 100*e* are accommodated in a group container 30 formed of, for example, synthetic resin. Each of the spring connectors 100*a* to 100*e* is disposed so that only its small-diameter portion 111 shown in FIG. 2 protrudes in parallel from each of its correspondingly disposed holes 31 to 35 of the group container 30.

Figure 3A:
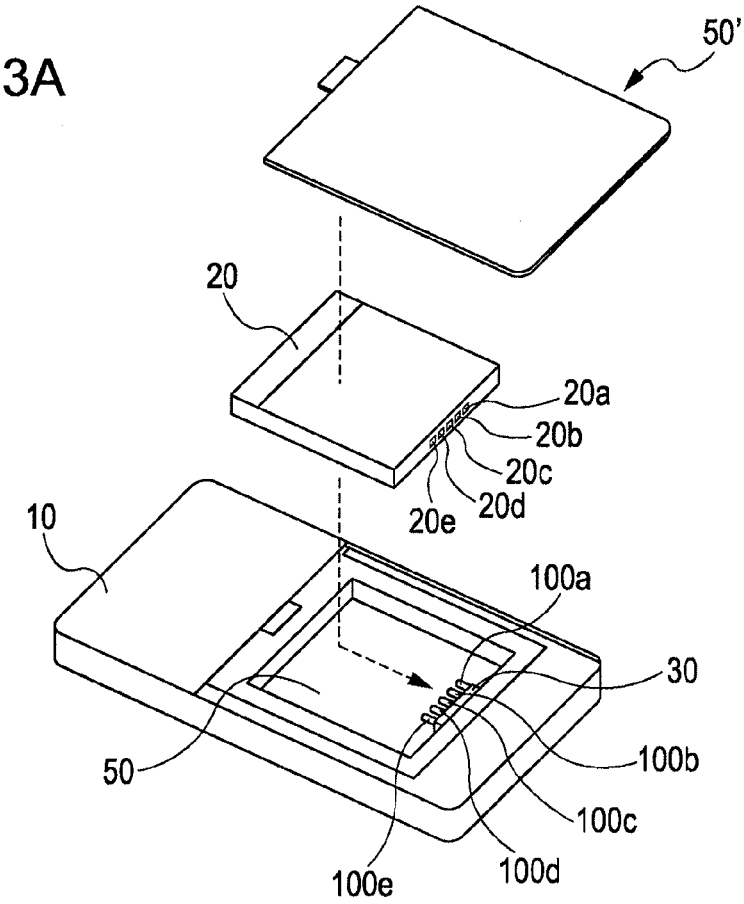
FIGS. 3A and 3B are each a perspective view of a terminal provided with the spring connector according to the first embodiment of the present invention, with FIG. 3A showing a state in which a battery is removed and FIG. 3B showing a state in which the battery is fitted.

As shown in FIG. 3A, the group container 30 having the structure shown in FIG. 4 is disposed in a battery mounting portion 50. Here, as indicated by a broken arrow, the small-diameter portion 111 of each of the spring connectors 100*a* to 100*e* is arranged so as to be parallel to a direction of movement of the battery 20 when the battery 20 is accommodated in the battery mounting portion 50.

In the state in which the group container 30 is disposed in the battery mounting portion 50 in this way, the base portion 151 (see FIGS. 1 and 2) of each of the spring connectors 100*a* to 100*e* is connected to a circuit pattern for battery control and a circuit pattern for supplying electrical power of a circuit board (not shown). This connection is performed by, for example, soldering. The interval between each of the spring connectors 100*a* to 100*e* is the same as the interval between each of electrode portions 20*a*, 20*b*, 20*c*, 20*d*, and 20*e* of the battery 20.

Figure 3B:
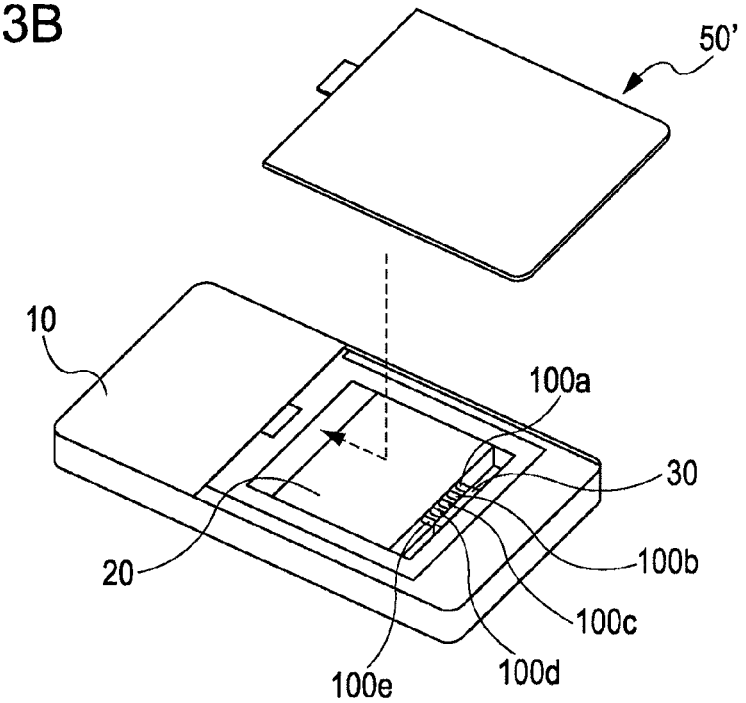

As shown in FIG. 3B, by accommodating the battery 20 in the battery mounting portion 50, an end of the small-diameter portion 111 of each of the spring connectors 100*a* to 100*e* contacts each of its corresponding electrode portions 20*a* to 20*e* of the battery 20. At this time, the end of the small-diameter portion 111 of each of the spring connectors 100*a* to 100*e* is pushed down slightly inwardly (towards the lower side in FIG. 1). Resilient force of the coil spring portions 113 of the respective springs 110 causes the ends of the small-diameter portions 111 at one end to firmly contact the corresponding electrode portions 20*a* to 20*e* of the battery 20.

A cover 50' shown in FIG. 3B is mounted to the battery mounting portion 50.

By providing the cellular phone terminal 10 having the above-described structure with the spring connectors 100, it is possible to keep the battery 20 and the spring connectors 100 in a good electrically connected state. That is, since the plungers and the coil springs in the spring connectors 100 are integrated to each other to form the pin-provided springs 110, the spring connectors 100 have forms that prevent an unstable conduction state from occurring from the small-diameter portions 111 (which are plungers) to the tubes 150. In particular, in the embodiment, since the ends 115 of the tube connection portions 114 of the respective pin-provided springs 110 are directly connected to the respective tubes 150 at the respective crimp portions 160, instantaneous cutoff does not occur in the spring connectors 100 even if any kind of shock is applied to the spring connectors 100. Therefore, it is possible to provide a stabilized conduction path and to prevent instantaneous cutoff caused by external shock from occurring.

Therefore, the cellular phone terminal 10 according to the embodiment makes it possible to reliably prevent troubles, such as data being lost or a call being cut off due to instantaneous cutoff of a battery (power supply) caused by shock.

By forming the plunger and the coil spring out of one metallic wire as shown in FIG. 5, the number of parts is reduced, so that costs are reduced.

4. Exemplary Structure of a Second Embodiment

Next, a second embodiment of the present invention will be described with reference to FIGS. 7 to 9.

Figure 7:
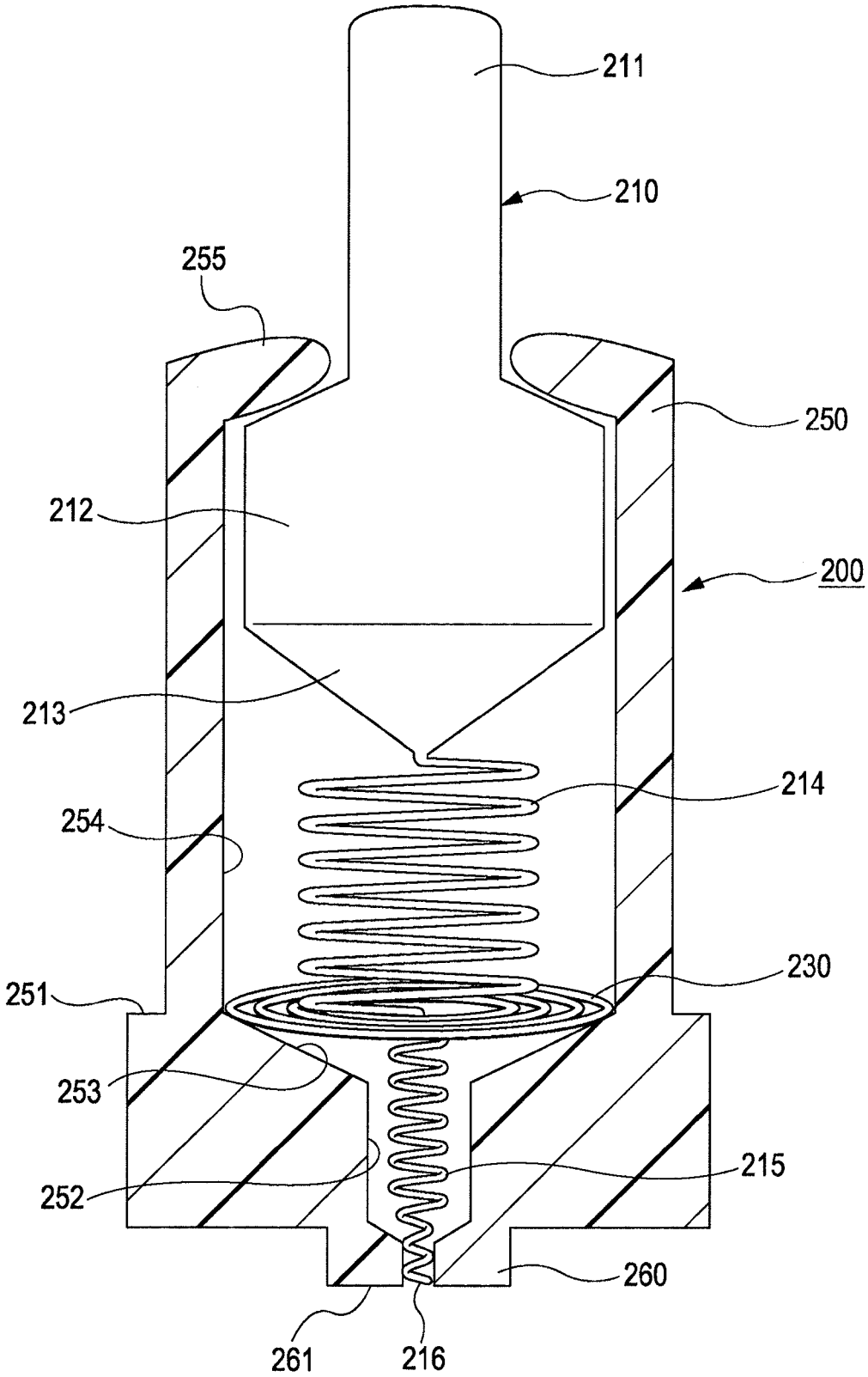
FIG. 7 is a sectional view of a modification of an embodiment of the present invention.

FIG. 7 is a sectional view of a spring connector of the second embodiment of the present invention.

As shown in FIG. 7, the spring connector 200 includes an inner conductor, formed of a conductive material, and an outer conductor, accommodating the inner conductor. That is, a pin-provided spring 210, formed of a conductive material (such as a metal), is accommodated in a tube 250, formed of a conductive material (such as a metal) and having a hollow inner side. The pin-provided spring 210 functions as a plunger and as a resilient member (spring). A detailed structure of the pin-provided spring 210 will be described later.

The pin-provided spring 210 includes a small-diameter portion 211, a large-diameter portion 212, a stepped portion 213, a coil spring portion 214, and a tube connection portion 215. The portions 211 to 215 are coaxially, continuously, and integrally formed with respect to each other. The tube 250 accommodating the pin-provided spring 210 is such that its base end side is a base portion 251 and such that a circular small-diameter clearance hole section 252 is provided in the base portion 251. A circular large-diameter clearance hole section 254 is formed continuously with the small-diameter clearance hole section 252. A conical portion 253 connects the small-diameter clearance hole section 252 and the large-diameter clearance hole section 254 to each other. A crimp portion 260 slightly protruding from the base portion 251 is provided at the lower end of the base portion 251 to crimp an end 216 of the tube connection portion 215 of the pin-provided spring 210.

The small-diameter portion 211 of the pin-provided spring 210 is exposed to the outside from an end 255 at the upper side of the large-diameter clearance hole section 254 of the tube 250. The end 255 of the tube 250 is narrowed, and is formed so that the large-diameter portion 212 of the pin-provided spring 210 does not fly out to the outside.

A fastener 230 is mounted to the coil spring portion 213 of the pin-provided spring 210. Using the fastener 230, the coil spring portion 213 is secured to the large-diameter clearance hole section 254 in the tube 250. Although it is desirable to form the fastener 230 out of a conductive material such as a metal, the fastener 230 may be formed of synthetic resin.

The small-diameter portion 211 protruding from the end 255 of the tube 250 can sink into the tube 250 by moving downward in a range in which the coil spring portion 214 in the tube 250 can be resiliently deformed (that is, compressed).

5. Method of Producing the Spring Connector According to the Second Embodiment

Next, a process of manufacturing the pin-provided spring 210 according to the second embodiment will be described with reference to FIGS. 8 and 9.

Figure 8A:
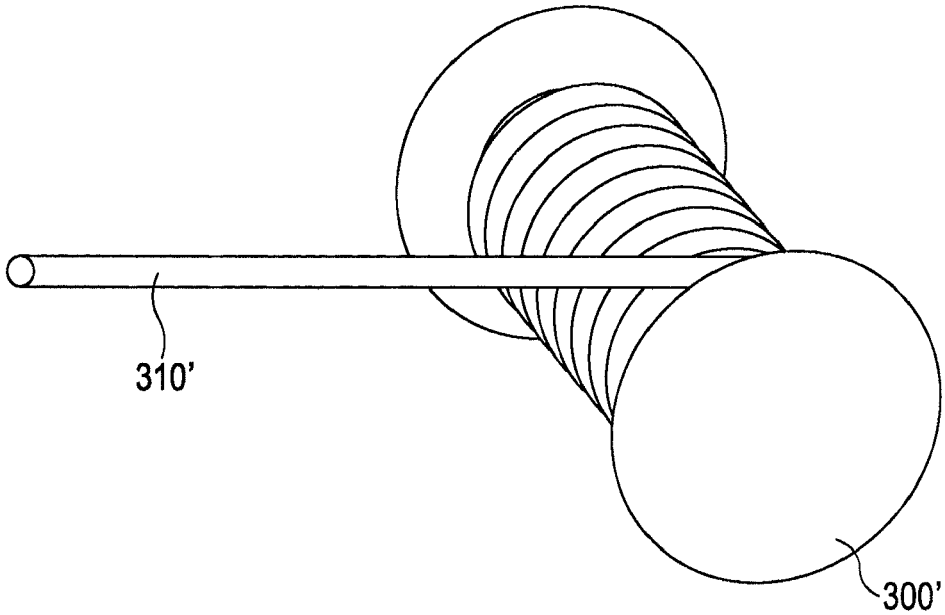
FIGS. 8A to 8C illustrate a process of producing a pin-provided spring in the modification of the embodiment of the present invention.

In the embodiment, the pin-provided spring 210 is formed by cutting a wire rod. That is, as shown in FIG. 8A, a conductive metal cable 310' is pulled from a drum 300' upon which the metal cable 310' is wound. Here, the thickness of the metal cable 310' is equal to the thickness of a large-diameter portion 212 of the pin-provided spring 210.

Figure 8B:
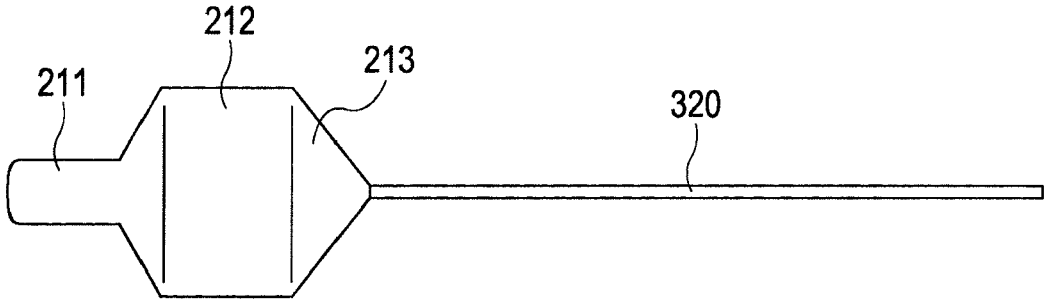

As shown in FIG. 8B, the pulled metal cable 310' is cut, to form the small-diameter potion 211, the large-diameter portion 212, the stepped portion 213, and a spring thin wire portion 320 in that order from an end of the metal cable 310'. In this state, the metal cable 310' is cut off from the drum 300'.

Figure 8C:
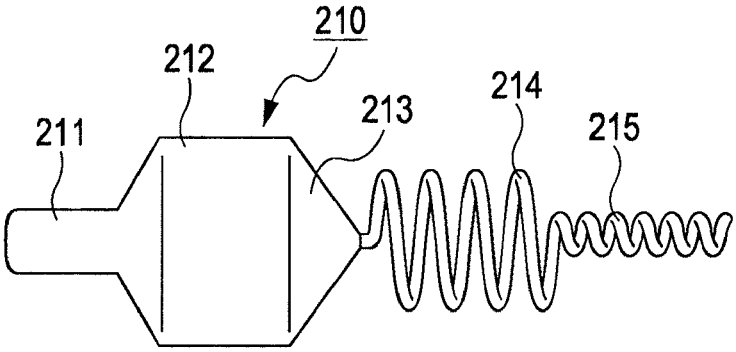

Thereafter, as shown in FIG. 8C, the spring thin line portion 320 is wound with certain gaps between portions of the spring thin line portion 320, to form the coil spring portion 214 and the tube connection portion 215. The spring thin line portion 320 functions as a compression coil spring providing resilient force.

Next, a process of disposing the spring 210 in the tube 250 will be described with reference to FIGS. 9A to 9C.

Figure 9A:
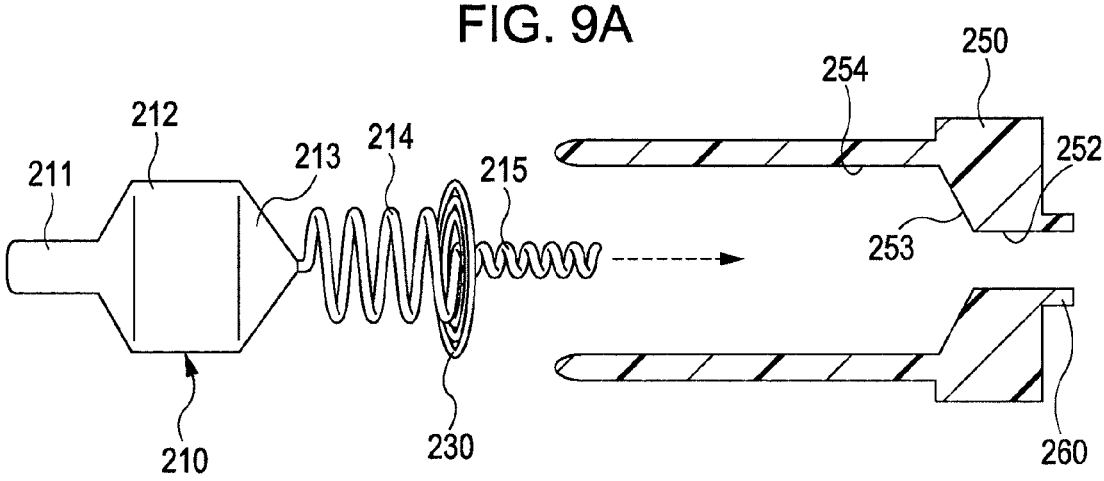
FIGS. 9A to 9C illustrate a process of producing a spring connector in the modification of the embodiment of the present invention.

As shown in FIG. 9A, a fastener 230 is mounted between the tube connection portion 115 and the coil spring portion 214 of the pin-provided spring 210 obtained in the process shown in FIGS. 8A to 8C.

In addition, as shown in FIG. 9A, an end of the tube connection portion 214 of the pin-provided spring 210 is inserted from the upper side of the tube 250, and inserted into the small-diameter clearance hole section 252. During this operation, an end of the tube 250 is not yet narrowed.

Figure 9B:
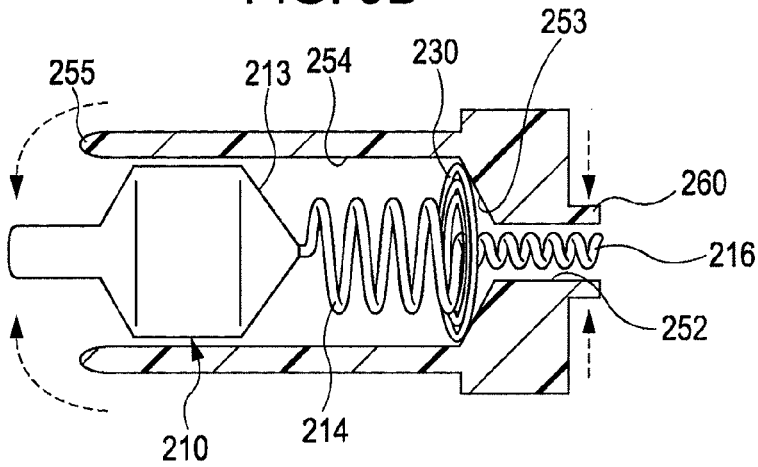

FIG. 9B shows a state in which the pin-provided spring 210 is disposed in the tube 250 in this way. In this state, with the end 216 of the tube connection portion 215 of the pin-provided spring 210 being inserted into a hole 261 in a crimp portion 260, as shown in FIG. 9B, the crimp portion 260 is narrowed; and, as shown in FIG. 9C, the end 216 of the pin-provided spring 210 is crimped at the tube 250.

Figure 9C:
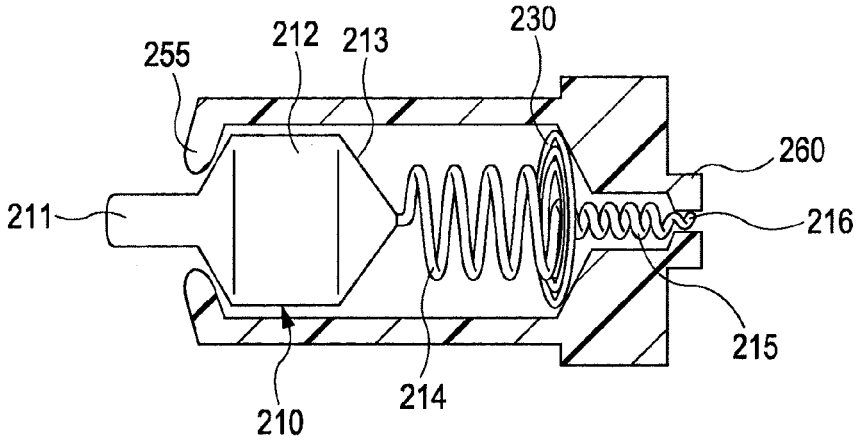
Figure 10:
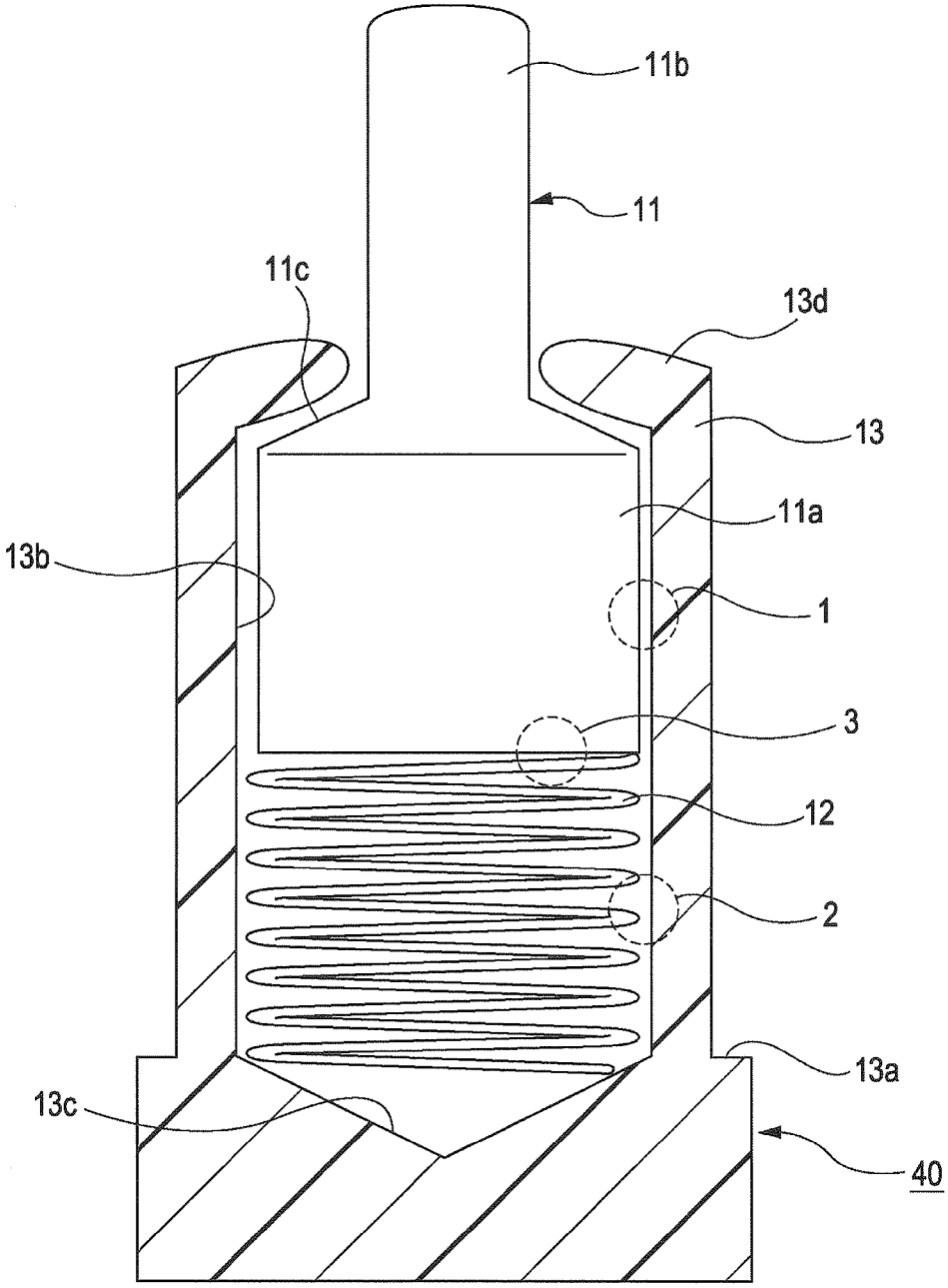
FIG. 10 is a sectional view of a related spring connector taken along line X-X in FIG. 11.
Figure 11:
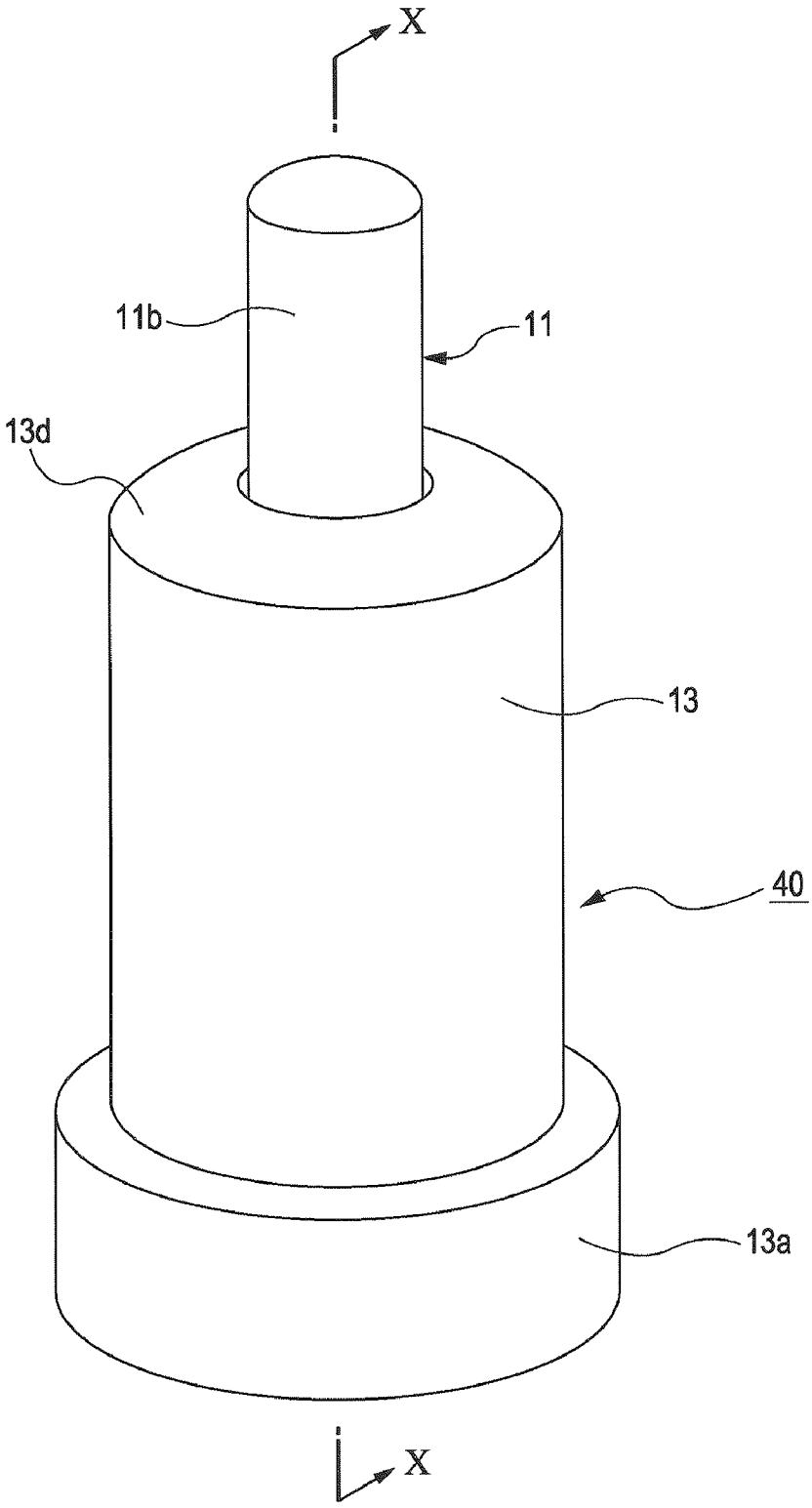
FIG. 11 is a perspective view of the related spring connector.

As shown in FIG. 9B, the end 255 of the tube 250 is narrowed inwardly, so that, as shown in FIG. 9C, the end 255 has a form that prevents the large-diameter portion 212 of the pin-provided spring 210 from flying out.

As with the spring connector 100, the spring connector 200 according to the second embodiment having such a structure can be used in, for example, a terminal, and similar advantages to those of the first embodiment can be obtained. That is, it is possible to provide a stabilized conduction path and to prevent instantaneous cutoff caused by external shock from occurring. By forming the plunger and the coil spring out of one metallic wire, the number of parts is reduced, so that costs are reduced.

The present application contains subject matter related to that disclosed in Japanese Priority Patent Application JP 2009-102244 filed in the Japan Patent Office on Apr. 20, 2009, the entire content of which is hereby incorporated by reference.

Although the embodiments of the present invention are described, the present invention is not limited to these embodiments. The present invention includes modifications and applications as long as they are within the gist of the present invention discussed in the claims. For example, although, in the embodiments, the spring connector is applied to the battery connection portion of the cellular phone terminal, it may be applied to other connection portions of the cellular phone terminal. For example, the spring connector may be applied to a portion where a power supply portion and an antenna of the cellular phone terminal are connected to each other. Further, the present invention may be applied to terminal devices other than the cellular phone terminal.

What is claimed is:

1. A spring connector comprising:

an inner conductor formed of a conductive material, the inner conductor having a small-diameter portion, a large-diameter portion, and a resilient portion axially disposed so as to be integrally and continuously formed with each other;

an outer conductor formed of a conductive material, the outer conductor being provided with a hole having a predetermined inside diameter, the outer conductor accommodating the large-diameter portion and the resilient portion in the hole while the small-diameter portion of the inner conductor protrudes from an end of the hole; and a fastener that engages and stops the resilient portion of the inner conductor in the hole of the outer conductor.

2. The spring connector according to claim 1, wherein the resilient portion of the inner conductor is formed of a coil spring, and wherein portions of a wire rod, which is used to form the coil spring, are wound without any gaps formed therebetween, and the small-diameter portion and the large-diameter portion are continuously and integrally formed with each other.

3. The spring connector according to claim 2, wherein the hole of the outer conductor includes a first hole portion and a second hole portion, the first hole portion accommodating the large-diameter portion and the resilient portion of the inner conductor, the second hole portion being formed continuously with the first hole portion, the diameter of the second hole portion being smaller than the diameter of the first hole portion, and wherein an end of the coil spring of the inner conductor has a diameter allowing the end of the coil spring to be inserted in the second hole portion, and the end of the coil spring inserted in the second hole portion is engaged and stopped.

4. The spring connector according to claim 1, wherein the small-diameter portion and the large-diameter portion of the inner conductor are formed by cutting a wire rod, and wherein the wire rod formed continuously with the large-diameter portion is cut to a small diameter and is wound, to form the resilient portion as a coil spring.

5. A terminal device comprising:

a spring connector including an inner conductor, an outer conductor and a fastener, the inner conductor being formed of a conductive material, the inner conductor having a small-diameter portion, a large-diameter portion, and a resilient portion integrally and continuously formed with each other, the outer conductor being formed of a conductive material, the outer conductor being provided with a hole having a predetermined inside diameter, the outer conductor accommodating the large-diameter portion and the resilient portion while the small-diameter portion protrudes from an end of the hole, the fastener engages and stops the resilient portion of the inner conductor in the hole of the outer conductor; and a connection terminal portion in which the spring connector is disposed.

* * * * *